US008277288B2

(12) United States Patent
Spivak et al.

(10) Patent No.: US 8,277,288 B2
(45) Date of Patent: Oct. 2, 2012

(54) PARTICLE BLAST CLEANING APPARATUS WITH PRESSURIZED CONTAINER

(75) Inventors: Philip Spivak, Los Angeles, CA (US); Oleg Zadorozhny, Los Angeles, CA (US)

(73) Assignee: Cold Jet LLC, Loveland, OH (US)

( * ) Notice: Subject to any disclaimer, the term of this patent is extended or adjusted under 35 U.S.C. 154(b) by 0 days.

(21) Appl. No.: 11/344,583

(22) Filed: Jan. 31, 2006

(65) Prior Publication Data

US 2006/0178092 A1 Aug. 10, 2006

Related U.S. Application Data

(60) Provisional application No. 60/648,490, filed on Jan. 31, 2005.

(51) Int. Cl.

| | |
|---|---|
| ***B24B 1/00*** | (2006.01) |
| ***B24B 7/19*** | (2006.01) |
| ***B24B 7/30*** | (2006.01) |
| ***B24B 9/00*** | (2006.01) |
| ***B24C 9/00*** | (2006.01) |
| ***B24C 7/00*** | (2006.01) |

(52) U.S. Cl. ..... 451/99; 451/41; 451/88; 451/100

(58) Field of Classification Search ..... 451/99, 451/41, 28, 75, 39, 88, 100, 101, 60
See application file for complete search history.

(56) References Cited

U.S. PATENT DOCUMENTS

| | | | | |
|---|---|---|---|---|
| 1,686,877 | A | 10/1928 | Peik | |
| 4,324,494 | A * | 4/1982 | Pryor et al. | 366/156.1 |
| 5,071,289 | A | 12/1991 | Spivak | |
| 5,249,426 | A * | 10/1993 | Spivak et al. | 62/605 |
| 5,288,028 | A * | 2/1994 | Spivak et al. | 239/683 |
| 5,431,594 | A * | 7/1995 | Shank, Jr. | 451/100 |
| 5,445,553 | A * | 8/1995 | Cryer et al. | 451/7 |
| 5,605,497 | A * | 2/1997 | Pickard | 451/90 |
| 5,947,800 | A * | 9/1999 | Fring | 451/99 |
| 6,174,225 | B1 * | 1/2001 | Becker | 451/75 |
| 6,524,172 | B1 * | 2/2003 | Rivir et al. | 451/99 |
| 2003/0199232 | A1 | 10/2003 | Rivir et al. | |
| 2004/0121711 | A1 | 6/2004 | Opel | |
| 2004/0173767 | A1 * | 9/2004 | Caskey | 251/121 |
| 2004/0224618 | A1 * | 11/2004 | Rivir et al. | 451/99 |
| 2005/0107005 | A1 * | 5/2005 | Lynn | 451/38 |

FOREIGN PATENT DOCUMENTS

| | | | |
|---|---|---|---|
| DE | 43 35 382 | A1 | 4/1995 |
| WO | WO 94/16861 | A | 8/1994 |

OTHER PUBLICATIONS

Written Opinion of the International Searching Authority (PCT Rule 43bis.1).

* cited by examiner

*Primary Examiner* — Lee D Wilson
*Assistant Examiner* — Alvin Grant
(74) *Attorney, Agent, or Firm* — Frost Brown Todd LLC

(57) ABSTRACT

A particle blast cleaning apparatus incorporates a pressurized container which is pressurized by the transport gas upon start up through a feeder which does not comprise an airlock. The feeder introduces the blast media into the transport stream. At start up, the transport gas pressurizes the container, flowing upwardly through the feeder until the container is substantially pressurized and the flow substantially ceases. The feeder rotor may be configured to crush or grind the particles.

15 Claims, 10 Drawing Sheets

PARTICLE BLAST CLEANING APPARATUS WITH PRESSURIZED CONTAINER

This application claims priority from U.S. Provisional Patent Application Ser. No. 60/648,490, filed Jan. 31, 2005, titled Particle Blast Cleaning Apparatus With Pressurized Container.

BACKGROUND OF THE INVENTION

The present invention relates generally to particle blast systems, and is particularly directed to a device which provides improved introduction of particles into a transport gas flow for ultimate delivery as entrained particles to a workpiece or other target. The invention will be specifically disclosed in connection with a cryogenic particle blast system which introduces particles from a pressurized container via a feeder without an airlock between the container and the discharge station.

Particle blasting systems have been around for several decades. Typically, particles, also known as blast media, are fed into a transport gas flow and are transported as entrained particles to a blast nozzle, from which the particles exit, being directed toward a workpiece or other target.

Carbon dioxide blasting systems are well known, and along with various associated component parts, are shown in U.S. Pat. Nos. 4,744,181, 4,843,770, 4,947,592, 5,018,667, 5,050,805, 5,071,289, 5,109,636, 5,188,151, 5,203,794, 5,249,426, 5,288,028, 5,301,509, 5,473,903, 5,520,572, 5,571,335, 5,660,580, 5,795,214, 6,024,304, 6,042,458, 6,346,035, 6,447,377, 6,695,679, 6,695,685, and 6,824,450, all of which are incorporated herein by reference.

Many prior art blasting system, such as disclosed therein, include rotating rotors which form an air lock, sealing between the hopper which holds the pellets and the flow of pressurized transport gas into which the particles are entrained and carried to the workpiece. Other prior art blasting systems utilize suction created by a Venturi nozzle typically located at the blasting gun usually requiring a two hose system. The present invention does not require the use of an airlock or a Venturi nozzle.

Although the present invention will be described herein in connection with a particle feeder for use with carbon dioxide blasting, it will be understood that the present invention is not limited in use or application to carbon dioxide blasting. The teachings of the present invention may be used in applications using any suitable type or size of particle blast media.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention.

Figure 1:
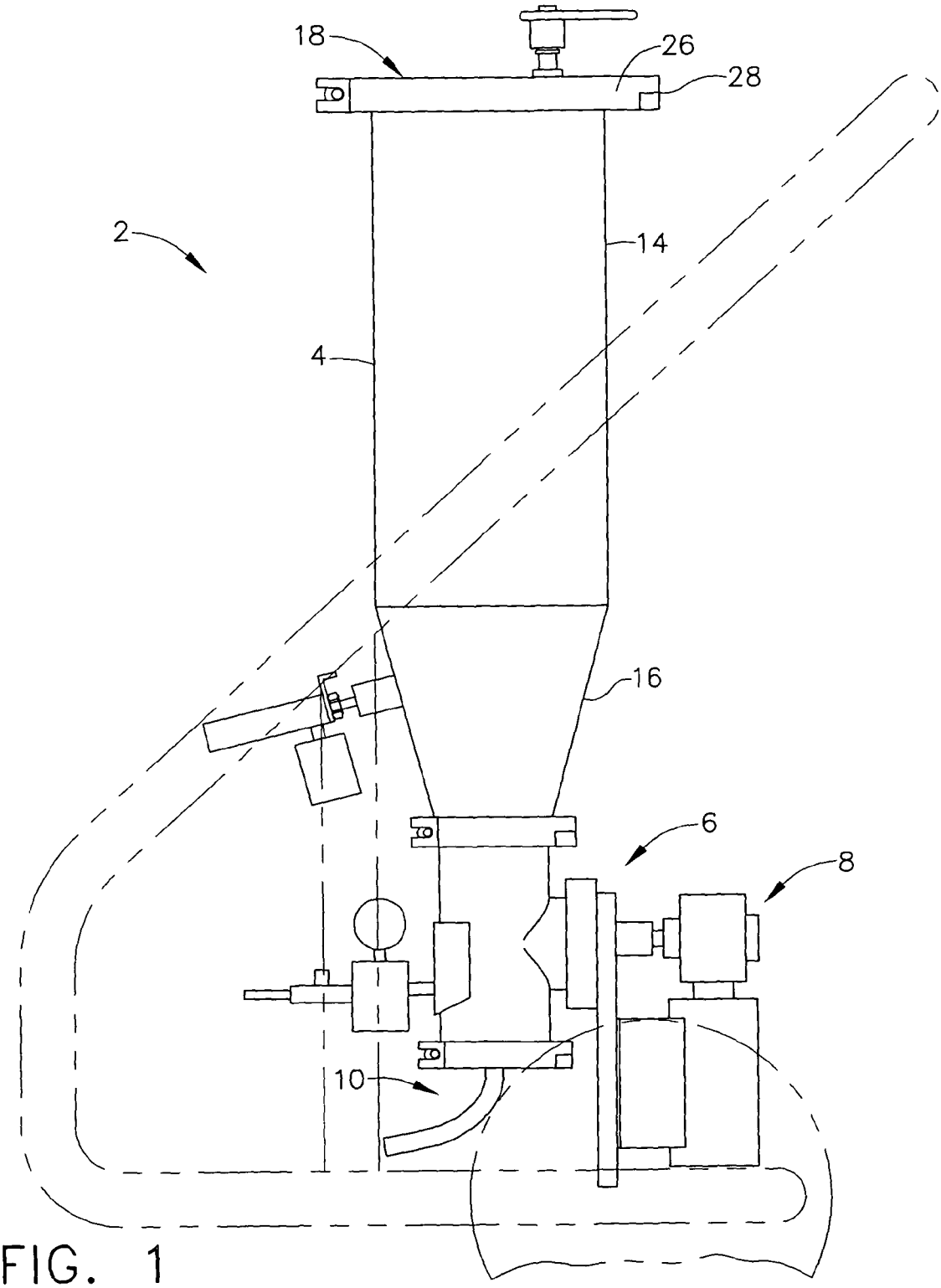
FIG. 1 is a side, diagrammatic view of a particle blast apparatus constructed in accordance with teachings of the present invention.

Reference will now be made in detail to the present preferred embodiment of the invention, an example of which is illustrated in the accompanying drawings.

DETAILED DESCRIPTION OF AN EMBODIMENT OF THE INVENTION

In the following description, like reference characters designate like or corresponding parts throughout the several views. Also, in the following description, it is to be understood that terms such as front, back, inside, outside, and the like are words of convenience and are not to be construed as limiting terms. Terminology used in this patent is not meant to be limiting insofar as devices described herein, or portions thereof, may be attached or utilized in other orientations. Referring in more detail to the drawings, an embodiment of the invention will now be described.

Figure 2:
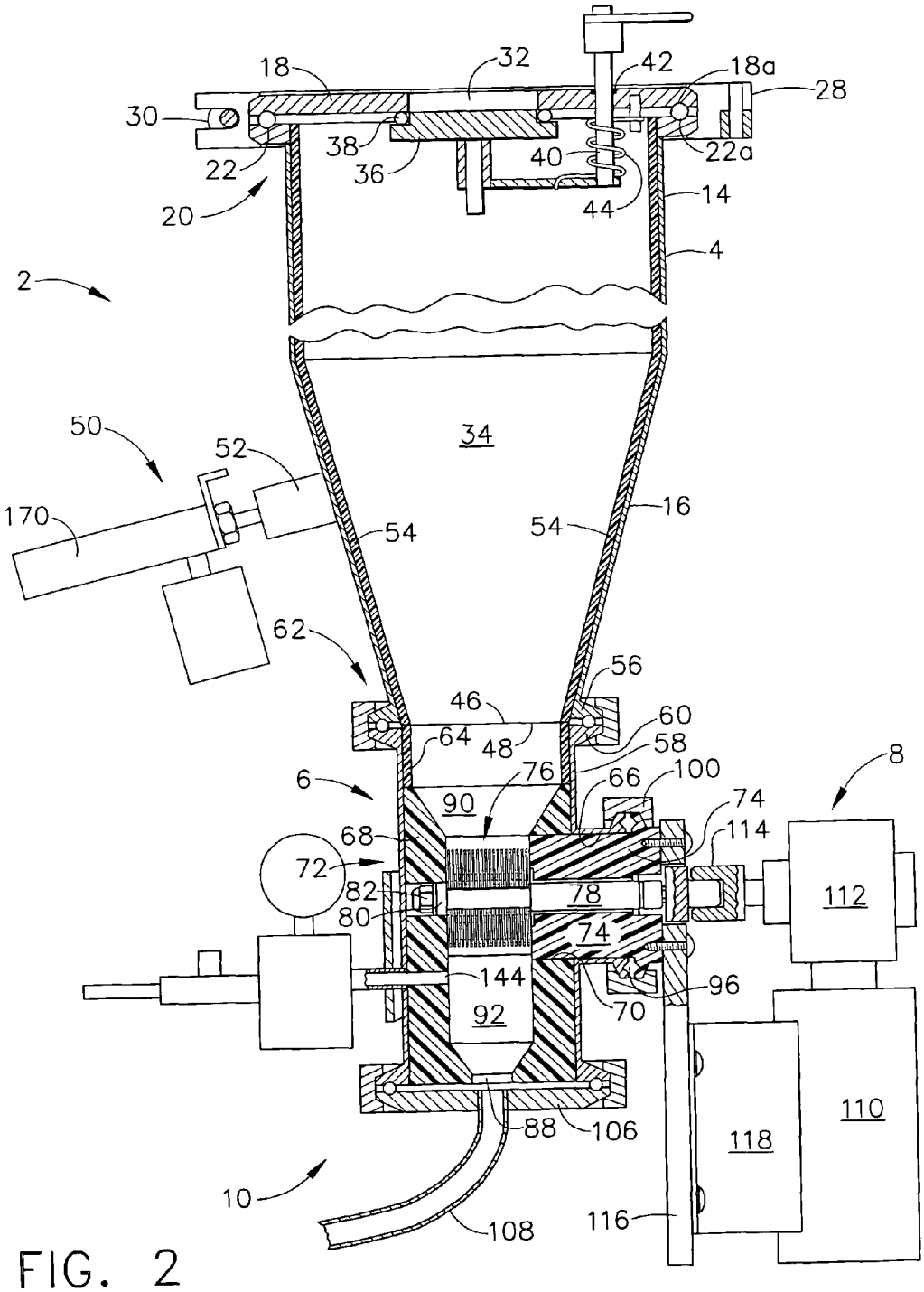
FIG. 2 is a side cross-sectional view of the hopper and feeder shown in FIG. 1, showing some components diagrammatically.

Referring to FIGS. 1 and 2, particle blast apparatus 2 includes container 4, feeder assembly 6, drive assembly 8 and exit port assembly 10. Particle blast apparatus 2 may be mounted to any suitable stand or cart, such as that shown in phantom lines and generally indicated by the numeral 12 in FIG. 1. Container 4 is configured to receive and hold media for blasting, such as carbon dioxide pellets or particles, and allow them to be transferred into the feeder assembly 6 for ultimate entrainment into the flow of transport gas. It will be appreciated that container 4 is not limited to the configuration illustrated and described herein, but may have any suitable shape.

In the embodiment depicted, container 4 is also configured to hold internal pressure, by preventing substantial (relative to the pressure and flow requirements of particle blast apparatus 2) pressure leakage out of container 4. Container 4 may also be referred to herein as pressure vessel 4 or vessel 4. Depending on the internal pressure, container 4 may be constructed to meet the ASME code for pressure vessels. Container 4 is illustrated as having upper portion 14 which is generally cylindrical and lower portion 16 which is conically shaped.

Cover 18 encloses open end 20, forming a pressure resistant seal therewith. Cover 18 is configured to mate with annular flange 22 of end 20. Axially aligned Annular grooves 18*a* and 22*a* are formed in cover 18 and flange 22, respectively, with seal 24 disposed partially in each groove 18*a* and 22*a*. Clamp 26, which is configured to mate with cover 18 and annular flange 22, is depicted have having a C-shaped cross section which engages the outer edges of cover 18 and annular flange 22, thereby compressing seal 24. Clamp 26 includes hinge 28 on one side with overcenter connector 30 disposed generally opposite hinge 28 that secures the ends of clamp 26 together. It is noted that cover 18 may be secured to open end 20 in any suitable manner, and is not limited to the configuration illustrated nor to clamp 26. Although similar clamping arrangements are used at various locations in the embodiment, the interconnecting of such components is not limited to such clamping arrangements.

Cover 18 includes media inlet opening 32 through which the blast media may be introduced into interior 34 of container 4. Cover 18 also includes plug member 36 having seal 38 which is configured to sealingly engage cover 18 so as to seal opening 32 in order to maintain internal pressure within container 4. Member 36 is carried by support 40 which is rotatable about and moveable along its axis. Seal 42 and support 40 may be resiliently biased by resilient member 44, depicted as a spring, to maintain member 36 in alignment with opening 32. To aid in this alignment, a stop member (not shown) may be disposed extending from cover 18 to engage the periphery of member 36 when member 36 is properly aligned with opening 32 so as to prevent resilient member 44 from over rotating support 40. Member 36 may be but is not required to be, resiliently urged into engagement with cover 18. Member 36 may be located by support 40 and resilient member 44 sufficiently close to opening 32 such that upon the introduction of pressurized gas into interior 34, member 36 will be forced into engagement with cover 18 as a result of the gas flow between member 36 and opening 32, which reduces the pressure on the top side of member 36, with the pressure imbalance being sufficient to move member 36 and seal 38 into sealing engagement with cover 18. As will be described below, this configuration allows member 36 to lower out of sealing engagement with cover 18 upon the reduction of the interior pressure when the transport gas ceases to be supplied to interior 34, leaving opening 32 unsealed. When the blast media is carbon dioxide, this opening 32 allows the gasses from sublimation to exit through opening 32 and precludes any pressure build up in interior 34. When member 36 is not urged closed against cover 18, support 40, may be rotated to provide a clearer path between opening 32 and interior 34, such as for charging carbon dioxide pellets into container 4.

Container 4 acts as a hopper, with lower portion 16 being configured to promote the flow of blast media toward its exit 46 which is adjacent entrance 48 of feeder assembly 6. Agitators or stirring rods (not shown) may be located within interior 34 to assist in promoting the flow of the blast media. Such agitators or stirring rods, may be mounted and actuated through any suitable configuration. Energy imparting assembly 50 may be used to impart energy externally to container 4 by periodically impacting the exterior of container 4 with mass 52, which promotes flow and the break up of any agglomerated clumps of media, as is known in the case of carbon dioxide pellets. Assembly 50 may be mounted and actuated through any suitable configuration, such being mounted to the stand or cart 12. For example, mass 52 may be actuated pneumatically to reciprocate periodically to strike container 4, such as repeatedly at a fixed or variable rate, or such as once when pellet flow is initiated or terminated.

Container 4 may include, but is not required to include, liner 54 disposed adjacent the walls of container 4 as depicted. Liner 54 may have insulating properties, and may be maintained adjacent the walls in any suitable manner, such as adhesive, or such as being configured to provide its own structural integrity conforming closely to the interior wall shape of container 4. Liner 54 may comprise several pieces or a single piece, and may fully cover the interior of the walls of container 4. Liner 54 may extend beyond exit 46 and into feeder assembly 6, as shown. Liner 54 may be made of polyethylene or any suitable material.

In the embodiment depicted, as seen in FIG. 2, feeder assembly 6 is connected to lower end 56 of container 4. Feeder housing 58 is sealingly secured at its upper end 60 to lower end 56 using a similar flange, seal and overcenter clamp arrangement, general indicated at 62, as described above between cover 18 and container 4. Alternatively, feeder housing 60 may be integral with container 4. Feeder housing 60 is depicted as generally circular, although any suitable shape may be used, with entrance 48 shaped complementarily to exit 46. Feeder housing 60 defines generally cylindrical bore 64 and transverse bore 66 that intersects with bore 64. Cylindrical bore 64 receives complementarily shaped liner 68, which includes transverse bore 70 aligned with transverse bore 66. Liner 68 may be made of UHMW or any suitable material. Rotor assembly 72 is disposed at least partially in transverse bore 70.

Figure 3:
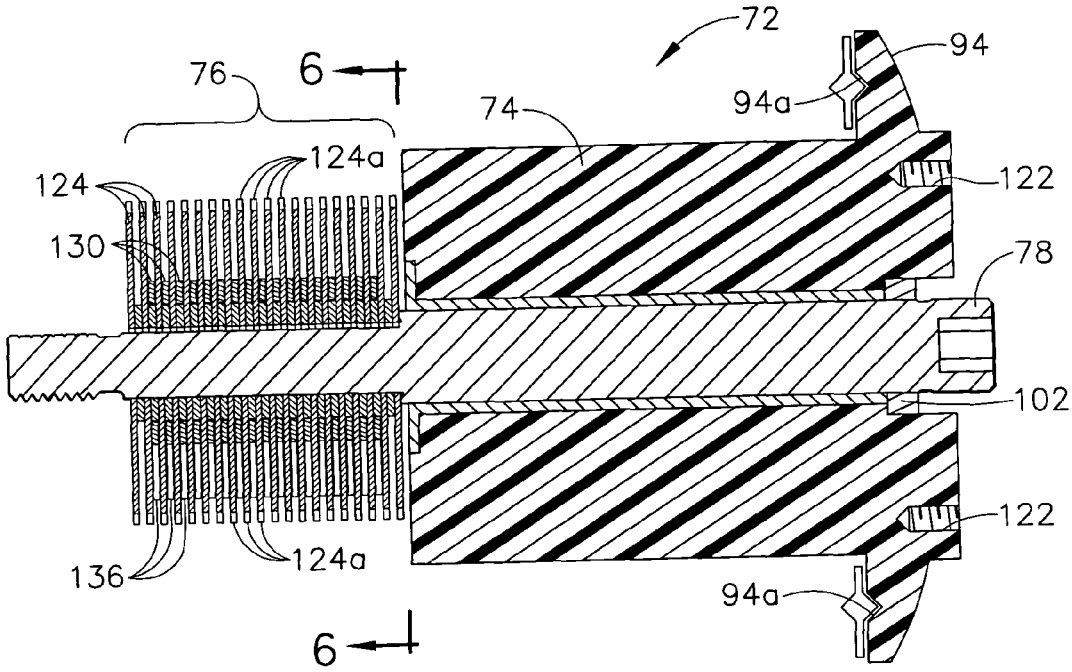
FIG. 3 is a side cross-sectional view of the rotor assembly shown in FIG. 1.

Referring also to FIG. 3, rotor assembly 72 includes bearing block 74 and rotor 76 carried by shaft 78. Shaft 78 includes bearing 80 which is retained thereon by nut 82. Liner 68 includes bore 84 which locates and supports bearing 80. Bearing 80 may be a rotating bearing with its outer race being supported by bore 84, or may be a bushing which is rotatably supported by bore 84. Bearing block may be made of UHMW or any suitable material.

Liner 68 defines feeder throat 86, which is a passageway communicating between entrance 48 and exit 88 of feeder 6. Rotor 76 is disposed in throat 86. Inlet 90 is located immediately upstream of rotor 76 and discharge station 92 is located immediately downstream of rotor 76. Bearing block 74 is disposed in transverse bores 66 and 70. As seen in FIG. 3, bearing block 74 includes annular flange 94 which is shaped complementarily to annular flange 96 of housing 58. Both flanges 94 and 96 include annular grooves 94*a* and 96*a*, which receive complementarily shaped seal 98. Over center clamp 100 engages flanges 94 and 96 in the same manner as described above, retaining and sealing rotor assembly 72 in place. Seal 102 sealing engages shaft 78 to seal between shaft 78 and bearing block 74.

In the embodiment depicted, the central portion of feeder throat 86 has a generally rectangular horizontal cross section with rounded corners, the beginning of which appears in FIG. 3 as arcuate line 86*a*. Liner 68 includes generally conical entrance 68*a* leading to the rectangular area of throat 86. The general rectangular cross sectional shape remains through discharge station 92, decreasing in area and transitioning beginning at the location indicated as 86*b* to a generally circular shape at the location indicated as 86*c* adjacent exit 88.

Exit port assembly 10 is connected to lower end 104 of feeder 6. Exit port assembly 10 includes member 106, which is connected thereto by an overcenter clamping arrangement similar to those described above, and exit tube 108 which is configured to have a delivery hose (not shown) attached thereto.

Drive assembly 8 includes motor 110 drivingly connected to shaft 78 through right angle transmission 112 and coupling 114 which is configured to couple with shaft 78. Motor 110 is carried by base 116 through bracket 118. Base 116 is secured to bearing block 74 through fasteners 120 threaded into bearing block at 122. In the embodiment depicted, motor 110 is an electric motor, although it may be any power source, such as driven pneumatically, suitable to rotate shaft 78. Right angle transmission 112 may include a reduction, and depending on the orientation of motor 110, may be omitted.

Figure 4:
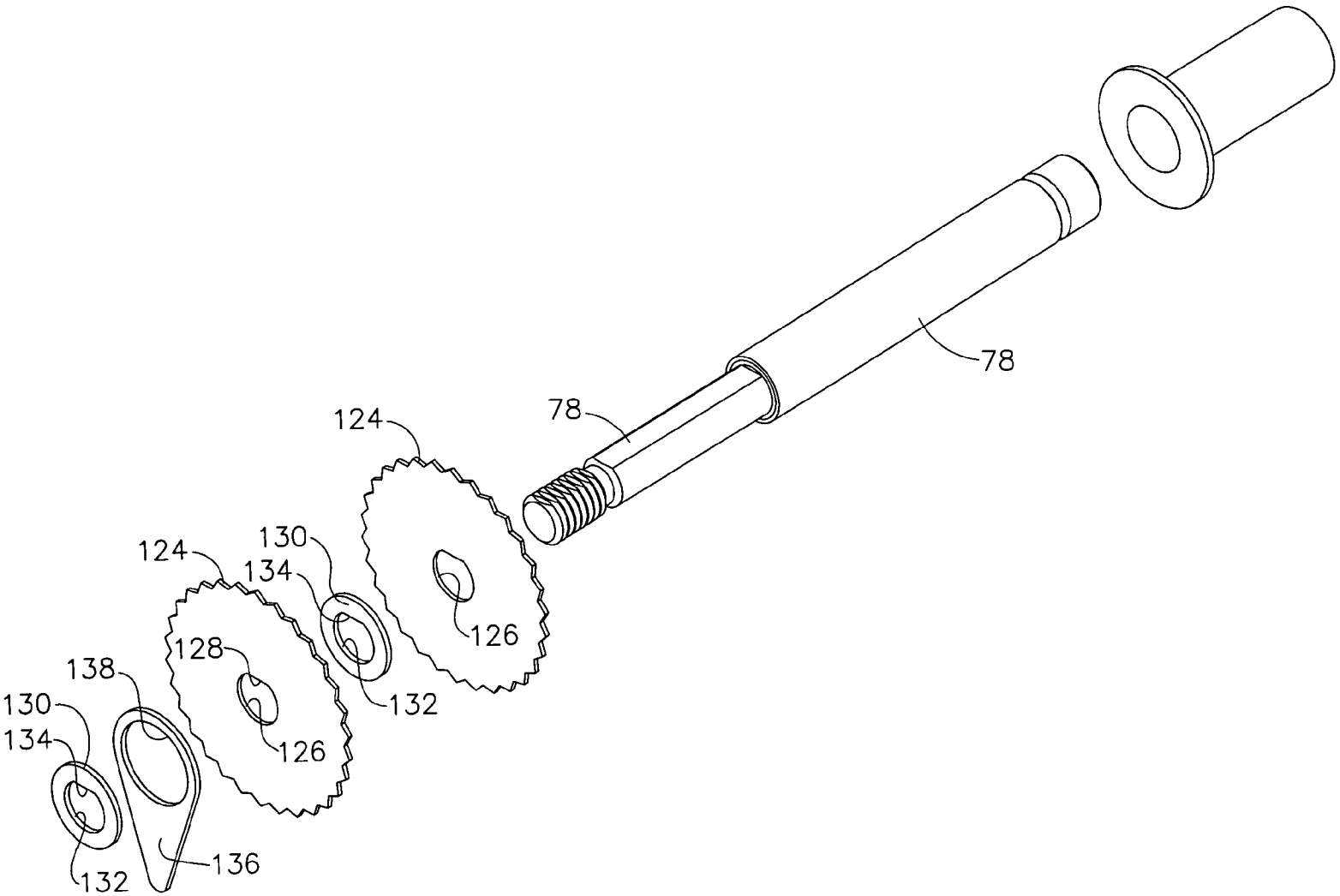
FIG. 4 is fragmentary exploded perspective view of the disks, spacers and cleaning arms of the rotor and shaft shown in FIG. 3. (a side view of the liner of the feeder, with the surrounding housing shown in phantom.)
Figure 5:
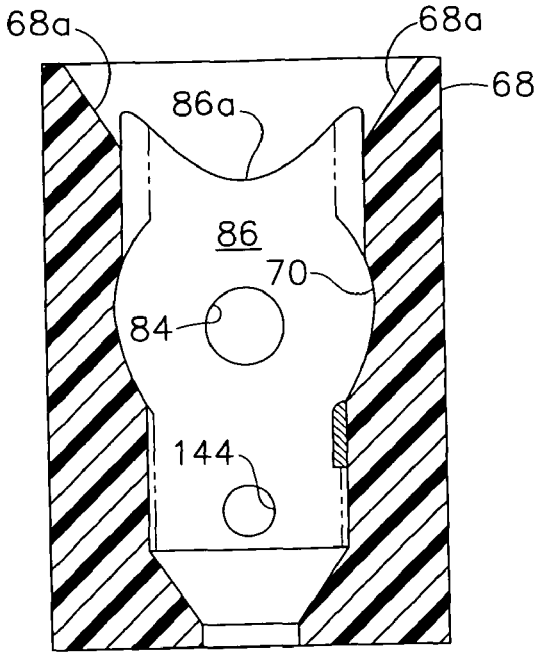
FIG. 5 is a side cross-sectional view of the liner of FIG. 4, taken along its center axis, generally perpendicular to the axis of rotation of the rotor.

In the embodiment depicted in FIG. 3, rotor 76 is configured to grind or crush carbon dioxide pellets or particles in the process of the blast media flowing from inlet 90 to discharge station 92. Referring also to FIG. 4, rotor 76 comprises a plurality of spaced apart, generally parallel disks 124 carried by shaft 78. Disks 124 include openings 126 shaped complementarily to an end portion of shaft 78. Openings 126 have respective flats 128 shaped complementarily to flat 78*a* of shaft 78 to prevent rotational slippage between disks 124 and shaft 78, ensuring rotation of disks 124 under load. Any suitable configuration for mounting disks 124 to shaft 78 without rotation therebetween may be used, such as for example splines. Disks 124 are spaced apart by spacers 130 which have a generally circular outer shape and central opening 132 with flat 134, shaped complementarily to shaft 78 and flat 78*a*. Openings 132 and flats 134 locate spacers 130 in the appropriate centered location and prevent slippage with shaft 78. Spacers 130 may be integral with disks 124. Arms 136 may be disposed between adjacent disks 124, as shown in FIG. 3. Arms 136 include openings 138 which are shaped and sized to rotate about the outer diameter of spacers 130, thus being independent of the rotation of shaft 78. Arms 136 may not be interposed between every pair of adjacent disks 124, such as seen omitted from the two end pairs of disks 124 in FIG. 3.

Figure 6:
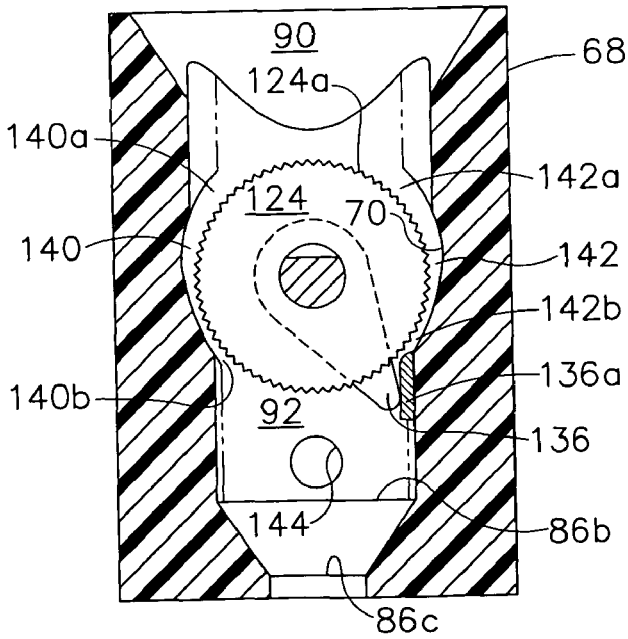
FIG. 6 is a side view of the liner similar to FIG. 5 and the rotor assembly, with the shaft illustrated in cross-section taken along line 6-6 of FIG. 3.
Figure 7:
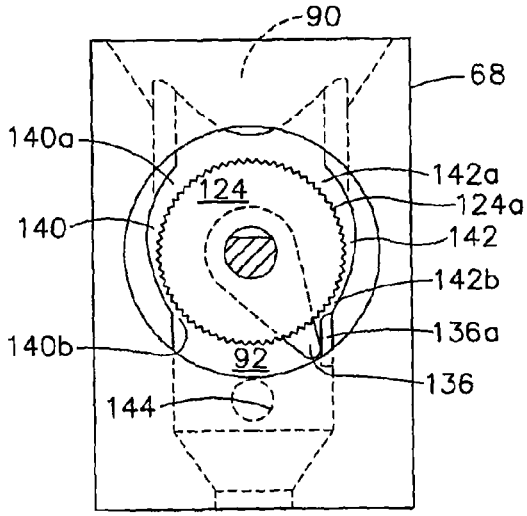
FIG. 7 is a side view of the liner and the rotor, with the shaft illustrated in cross-section taken along line 6-6 of FIG. 3.

In FIG. 6, liner 68 is shown in cross section, taken along its center axis generally perpendicular to the axis of rotation of shaft 78. FIG. 7 is similar to FIG. 6, with liner 68 not shown in cross section. In the embodiment depicted in FIGS. 6 and 7, disks 124 have rough outer peripheries 124*a* configured in the figure as an endless series of individual teeth defining the outer circumferences of disks 124. Outer peripheries 124*a* may also be characterized as jagged. Any suitable outer perimeter configuration may be used. In the instance of teeth, any suitable configuration may be used, such triangular having straight or curved sides. Teeth may be symmetrical or non-symmetrical teeth.

As seen in FIGS. 6 and 7, rotor throats 140 (counter clockwise rotation) and 142 (clockwise rotation), the radial space between bore 70 and disks 124, are not necessarily constant throughout the angular rotation of disks 124, converging in the applicable direction of rotation. Entrance 140*a* and 142*a* of rotor throats 140 and 142, respectively, are larger than exits 140*b* and 142*b*, respectively, of rotor throats 140 and 142. In the embodiment depicted, entrance 140*a* has a dimension of about 3/16", while exit 140*b* has a dimension of about 1/64", and entrance 142*a* has a dimension of about 1/16", while exit 142*b* has a dimension of about 1/64".

As rotor 76 rotates in the feeding direction (counter clockwise as illustrated), crushable blast media, such as carbon dioxide particles or pellets flow through entrance 140*a* and are radially advanced being wedged into the narrowing rotor throat, thereby being cut or crushed by disks 124 and metered out at discharge station 92 as fine particles entrained into the transport gas flow, which enters through opening 144 at the end of inlet port 146 (which is selectively connectable to a source of transport gas) and flows out through exit tube 108 with the entrained particles. The flow rate of blast media, such as carbon dioxide particles, produced by rotation of rotor 76 may have little dependence on the rotational speed of rotor 76, and may be dependant on the dimension of the rotor throat entrance. Thus, two flow rates may be obtained by rotor throat entrance 140*b* having a different dimension than rotor throat entrance 140*a*. Two distinct flow rates might be obtained by changing the direction of rotation of rotor 76.

FIG. 6 illustrates that the non-rotating arms 136 extend sufficiently to engage liner 68 as shown, thereby being blocked from rotating with shaft 78. Bearing member 136*a* may be, but is not required, included to provide a bearing surface for the end of arms 136. Arms 136 function to clean media particles from the spaces between adjacent disks 124. The lengths of arms 136 are selected not to interfere with insertion of rotor 76 into throat 86 as illustrated.

Figure 8:
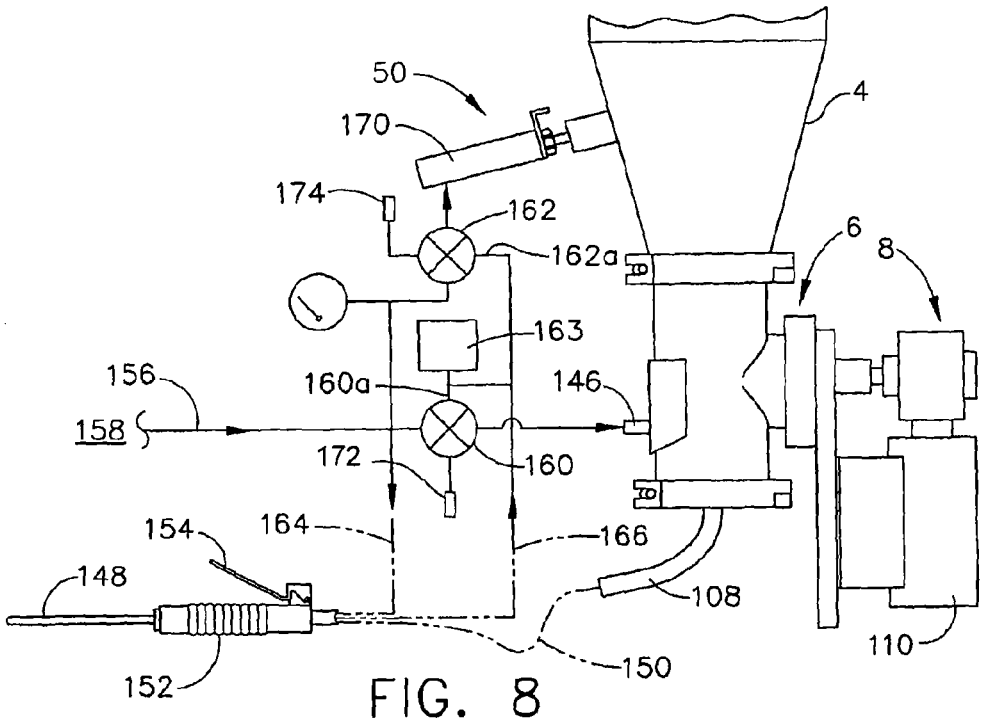
FIG. 8 is a schematic illustration of the pneumatic control connections of the particle blast apparatus shown in FIG. 1.

Referring also to FIG. 8, exit tube 108 is connected to blast nozzle 148 via delivery hose, diagrammatically represented by phantom line 150. Blast nozzle 148 is connected to handle 152 having pneumatic trigger 154. Pneumatically tube 156 is connected to a source of pressurized transport gas, generally indicated at 158. Although any suitable gas may be used as the transport gas at any suitable pressure, in the embodiment depicted, compressed air is used as the transport gas at a pressure of 100-125 psig. It may be, but is not necessarily required to be dried. Tubing 156 places source 158 in fluid communication with flow control valve 160 and thumper control valve 162. Pneumatic control line 164 connects source 158 to trigger 154. When trigger 154 is actuated, source is placed in communication with pneumatic control line 166, thereby pressurizing valve control port 160*a* and motor control pneumatic switch 168. Flow control valve 160 then places inlet port 146 in fluid communication with source 158, allowing transport gas to flow through opening 144. Concomitantly, switch 168 activates motor 110, although switch 168 may be configured to provide delayed activation. Alternatively, motor 110 may be pneumatic, and switch 168 may be replaced by a valve controlled by pneumatic control line 166. Pneumatic control line 166 also pressurizes valve control port 162*a* of thumper control valve 162, which pressurizes cylinder 170 from source 158, in the embodiment depicted, spacing mass 52 from container 4. Cylinder 170 may be configured with a return spring which causes mass 52 to impact container 4 when pressure to cylinder 170 is removed. Silencers/relief valves 172 and 174 may be connected to valves 160 and 162 to relieve pressure, when it drops below a predetermined level, from the controlled side of valves 160 and 162 when switch 154 is released.

Referring to FIGS. 2-7, when trigger 154 is actuated, transport gas initially flows into through opening 144. The transport gas will begin flowing out through exit tube 108 and up through or past rotor 76. The reduction in cross sectional area of feeder throat 86 towards exit tube 108 presents resistance to flow, back pressuring discharge station 92. The back pressure assists in causing flow through or around rotor 76. As can be seen in FIGS. 3, 6 and 7, the transport gas may flow upward into interior 34 through the spaces between disks 124 as well as around the periphery of rotor 76 through the rotor throat. This upflow may lift any blast media, such as carbon dioxide pellets, up off of rotor 76 at the time that motor 110 begins rotating rotor 76, high start up torque may be avoided. The transport gas flows through the gap between member 36 and cover 18, forcing it into sealing engagement with cover 18 and sealing opening 32. At start up, the initial pressure and volume of the transport gas reaching blast nozzle 148 is initially dimensioned, as a result of the accumulator effect of the gas flow into the container. This results in a "soft on" at the nozzle, reaching full pressure once interior 34 is substantially fully pressurized. Once interior 34 is substantially pressurized, upflow through and around rotor 76 will substantially cease, although interior 34 will act as an accumulator smoothing many fluctuations in pressure. Optionally, to promote upflow continuously, a small valve (not shown), such as a needle valve, by may be placed in fluid communication with interior 34, such as on and through cover 18.

When trigger 154 is released, rotor 76 stops rotating stopping delivery of blast media, and the transport gas ceases being supplied through opening 144. The pressurized gas within interior 34 of container 4 flows downward through and around rotor 76 and out through blast nozzle 148, clearing delivery hose 150 and blast nozzle 148 of blast media such as carbon dioxide pellets. When the pressure in the pneumatic tubes between the control valves and inlet port 146 drops below the predetermined set point for silencers/relief valves 172 and 174, they will open, releasing pressure and decreasing the time required for the pressure to vent. When the pressure in interior 34 drops low enough, member 36 will unseal against cover 18.

In the embodiment depicted, feeder 6 does not function as an air lock, which would normally be found between interior 34 and the ambient, typically between inlet 90 to feeder 6 and discharge station 92. Interior 34 remains in fluid communication with the ambient through the delivery hose and the nozzle at all times, even during operation. This, along with opening 32 being open when not in operation, allows gas from sublimation to escape from container 4, reducing or substantially preventing sublimation to liquid and any pressure build up.

Figure 9:
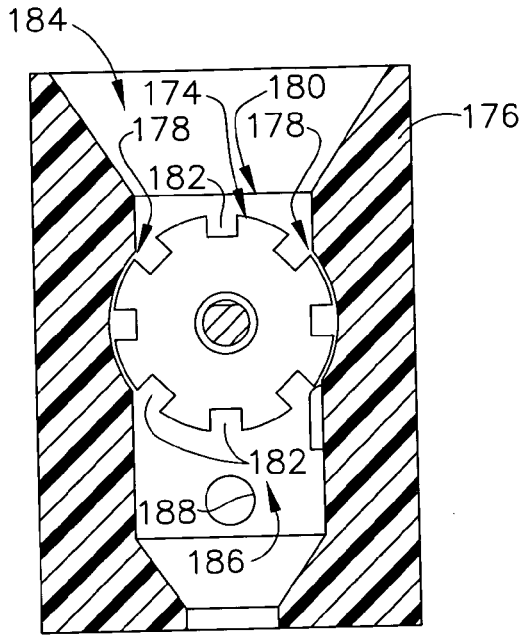
FIG. 9 is a side cross-sectional view of an embodiment of the liner and an alternate embodiment of the rotor assembly, taken generally at a vertical plan through its center axis.

Different configurations of the rotor, feeder throat and the rotor throat may be used in practicing the teachings of the present invention. Referring to FIG. 9, an alternate embodiment rotor 174 is shown disposed in liner 176. In the embodiment depicted, rotor throat 178 of feeder throat 180 is substantially constant about portions of the periphery of rotor 174. Rotor 174 includes a plurality of pockets 182 which receive the blast media, such as carbon dioxide pellets, at inlet or receiving station 184 and transport the media radially to discharge station 186, where the media is discharged into the flow of transport gas flowing out of opening 188, which is connected to a source of transport gas.

Rotor throat 178 with a substantially constant clearance dimension may be used with most any rotor configuration, whether the rotor and rotor throat are configured to transport the media or are configured to grind, cut or break the media, such as rotor 76 and rotor throat 140 described above.

Referring to FIG. 9, rotor 174 may be comprised of a plurality of spaced apart disks, similar to disks 124 described above, each with individual openings aligned with individual opening of the other disks, to form transversely extending pockets 182. Such configuration may result in grinding or cutting of blast media in addition to the radial transport. Alternatively arms (not shown) could be included, interposed between disks as described above, but configured to grind or cut blast media while in pockets 182. For example, such arms could extend from encircling the rotor shaft and engage a wall of the feeder throat below the rotor, such as against a bearing member, and configured to include a portion extending through pockets 182 after the openings of pockets 182 are fully occluded by the liner, such as at about 9 o'clock in FIG. 9.

Figure 10:
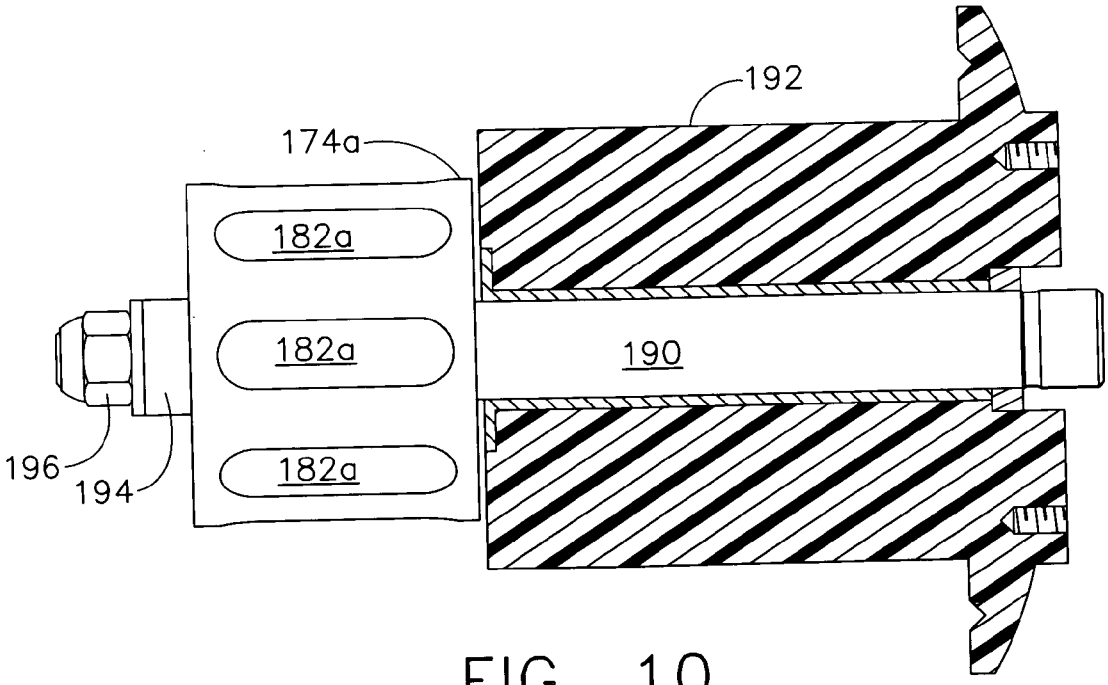
FIG. 10 is a side view of an embodiment of the rotor assembly of FIG. 9.

Referring to FIG. 10, rotor 174 may alternatively be a solid body, identified in FIG. 9 as 1741, having continuous transverse pockets 182*a* formed therein. Rotor 174*a* is supported by shaft 190 which is piloted by bearing block 192 and couples to a source of rotary power, such as motor 110 described above. Rotor 174*a* is driven by shaft 190, being configured to rotate therewith, such as by a flat, pin, splines, or any suitable configuration. Shaft 190 includes bearing 194, which may be supported by liner 176 in a manner similar to that described above for bearing 80, secured to shaft 190 by retainer 196 depicted as a nut.

Rotor 174*a*, bearing block 192, and associated components may be configured to be interchangeable with rotor assembly 72. For breakable (e.g., crushable, grindable, cutable) blast media, such as carbon dioxide, such interchangeability permits a single apparatus to utilize a range of particle types, such as whole pellets, fragmented pellets, or snow.

Figure 11:
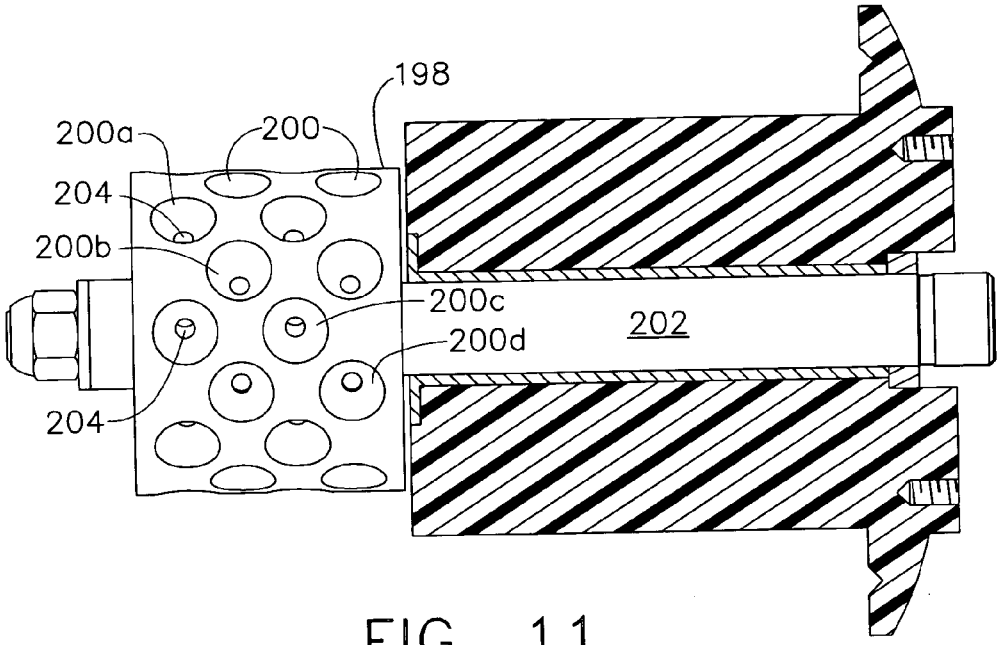
FIG. 11 is a side view of another alternate embodiment of a rotor assembly.
Figure 12:
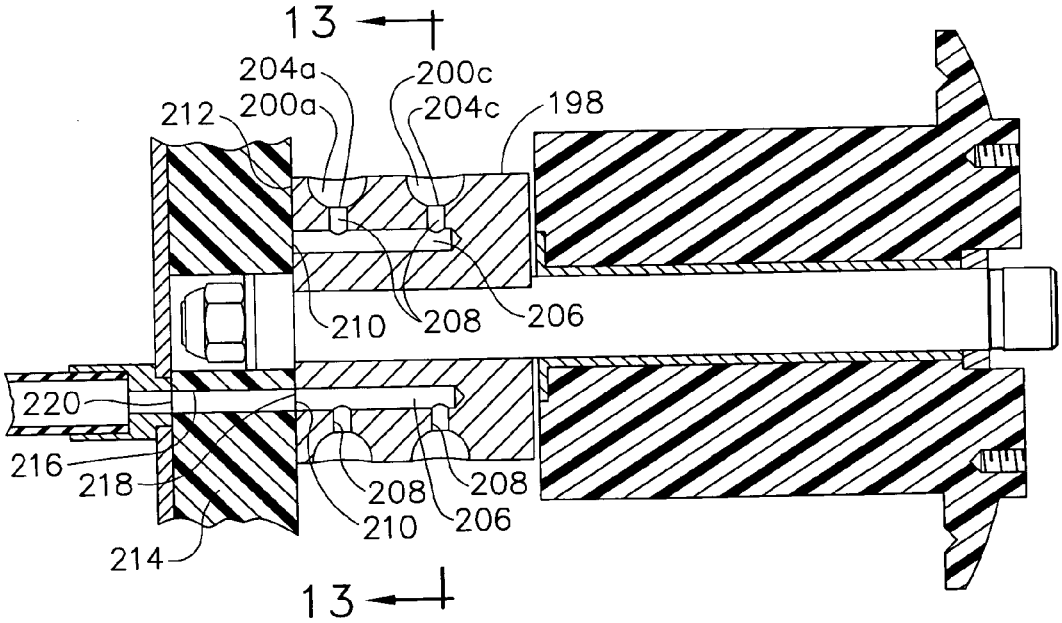
FIG. 12 is a cross-sectional side view of the rotor of FIG. 11 and a fragmentary cross-sectional view of the adjoining portion of the liner.

FIG. 11 illustrates another rotor embodiment, in which rotor 198 includes a plurality of spaced apart pockets 200 arranged in any suitable pattern. The pattern illustrated comprises circumferential rows of pockets 200, which are also aligned in rows generally parallel to the axis of rotation of rotor 198. The axial and circumferential rows are arranged such that the axial and circumferential widths of pockets 200 overlap, but do not intersect, each other, the pockets in adjacent circumferential rows being angularly spaced pockets from the pockets in the adjacent circumferential row. Rotor 198 and shaft 202 may be constructed similar to the construction of rotor 174*a* and shaft 190 described above, or may be of unitary construction, as seen in FIG. 12. It is noted that rotor 174*a* and shaft 190 may also be of unitary construction.

Figure 13:
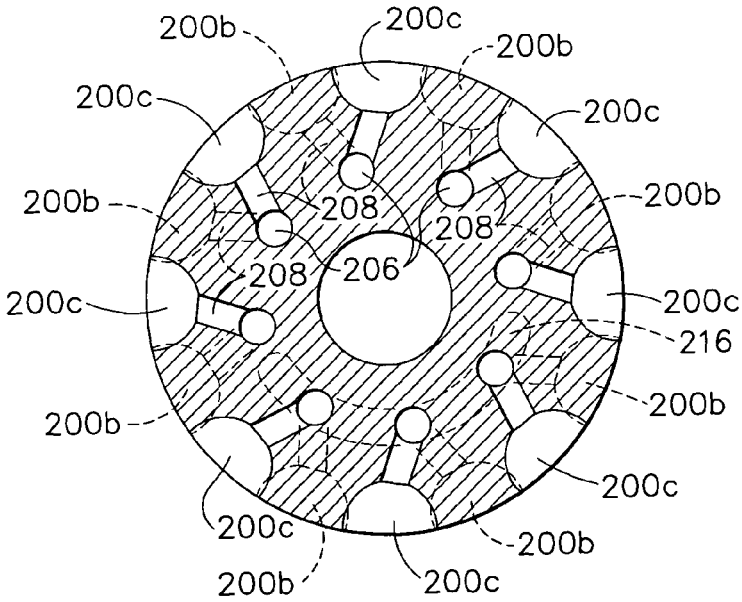
FIG. 13 is cross-sectional view taken along line 13-13 of FIG. 12.

As seen in FIG. 11, pockets 200 may include openings 204 which are in fluid in communications with a source of pressurized gas, such as the transport gas. Referring also to FIGS. 12 and 13, in the embodiment depicted, pockets 200*a* and 200*c* are exemplarily of pockets in alternate circumferential rows which are axially aligned with each other, as are pockets 200*b* and 200*d*. Axial passageways 206 are formed in rotor 198 for groups of adjacent pockets. Axial passageways 206 communicate with pockets 204*a*, 200*b*, 200*c* and 200*d* through pocket passageways 208, which terminate in openings 204 of pockets 200. Axial passageways are illustrated terminating in respective openings 210 at end 212 of rotor 198, forming a generally circular pattern of openings 210 similar to the arrangement of passageways 206 seen in the cross-section of FIG. 13. End 212 abuts liner 214, which includes arcuate opening 216 at liner surface 218 abutting end 212. Arcuate opening 216 is in fluid communication with passageway 220 which is connectable to a source of pressurized gas. In the embodiment depicted, passageway 220 is connected through external tubing to the transport gas source.

As seen in FIGS. 12 and 13, arcuate opening 216 is located to place a plurality of openings 210 in fluid communication with the source of pressurized gas for those pockets 200 at the discharge station, thereby assisting the evacuation of media from pockets 200. Arcuate 216 may be sized to be in fluid communication with only one passageway 206 at a time, communicating with an endless (while rotor 198 is rotating) succession of passageways 206 one at a time. Or, as illustrated, passageway 206 may be sized to function as a manifold in communication with a plurality of passageways 206 in succession providing a continuous flow of gas through pockets 200 over a range of the rotation of each pocket 200 at the discharge station.

The exact configuration of the rotors, pocket size and location, is not limited to those disclosed herein. The rotors may be made of any suitable material, such as stainless steel, such as for disks 124, or anodized aluminum for rotors 174*a* and 198.

Figure 14:
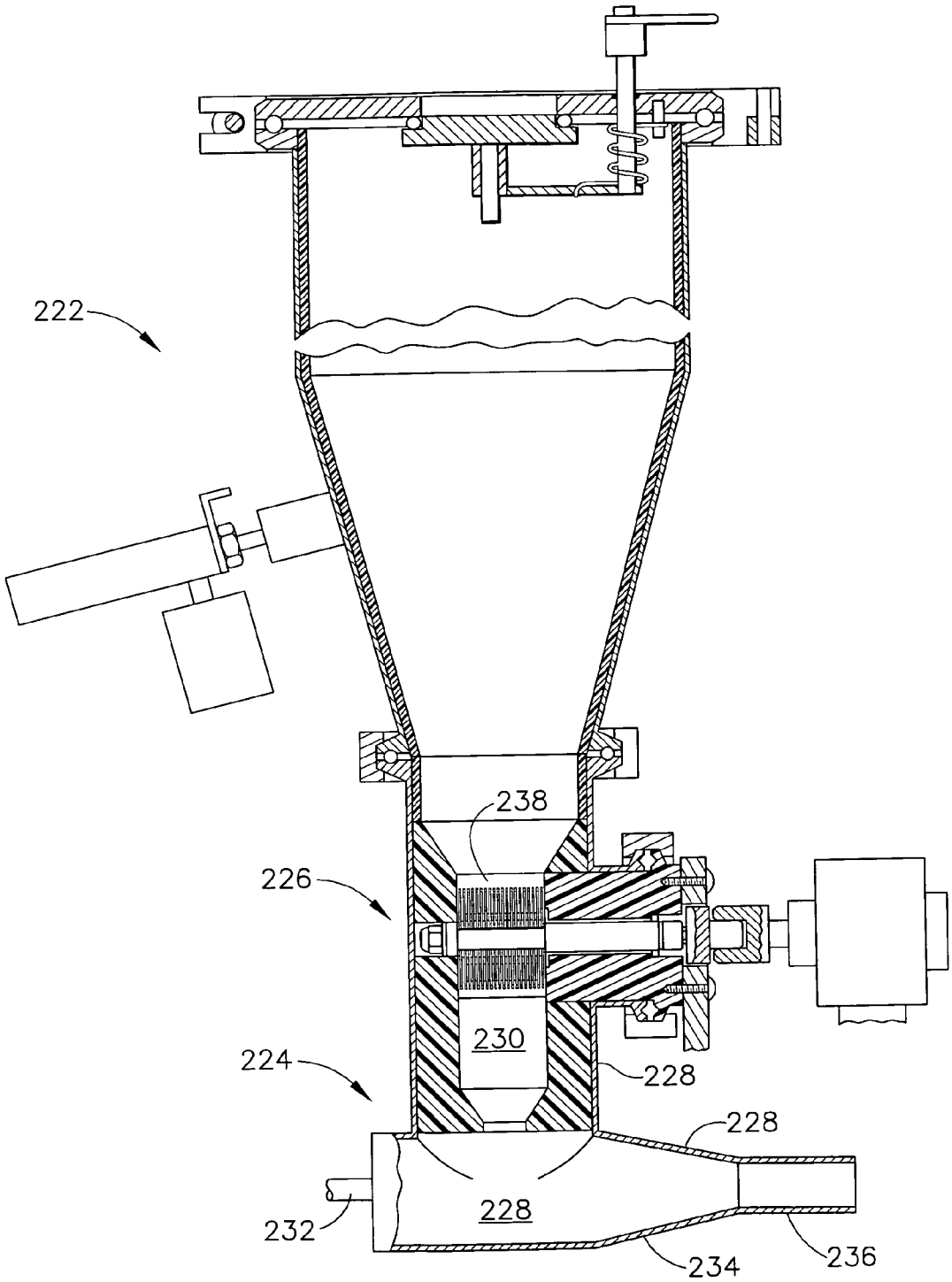
FIG. 14 is a side cross-secfional view of the hopper and feeder of an alternate embodiment of the particle blast apparatus.

Referring to FIG. 14, another embodiment is illustrated. Particle blast apparatus 222 is constructed the same as particle blast apparatus 2 described above, except exit port assembly 224 is different. Exit assembly 224, although illustrated as formed integral with feeder 226, sharing common housing 228, may be constructed separate and connected to feeder 226 through any suitable configuration, such as the overcenter clamp arrangement described above. In the embodiment depicted, exit port assembly 224 comprises chamber 228, configured to receive blast media from receiving station 230, transport gas inlet 232, converging portion 234 and exit tube 236, which is connected to the delivery hose (not shown).

Feeder 226 discharges blast media into discharge station 230, which becomes entrained in the transport gas flow in chamber 28, and flows out exit tube 236 into the delivery hose. The reducing cross sectional area of converging portion 234 presents resistance to flow, causing flow through or around rotor 238, as described in the previous embodiments. In the embodiment depicted, transport gas inlet 232 is generally aligned with the direction of flow out exit tube 236.

Figure 15:
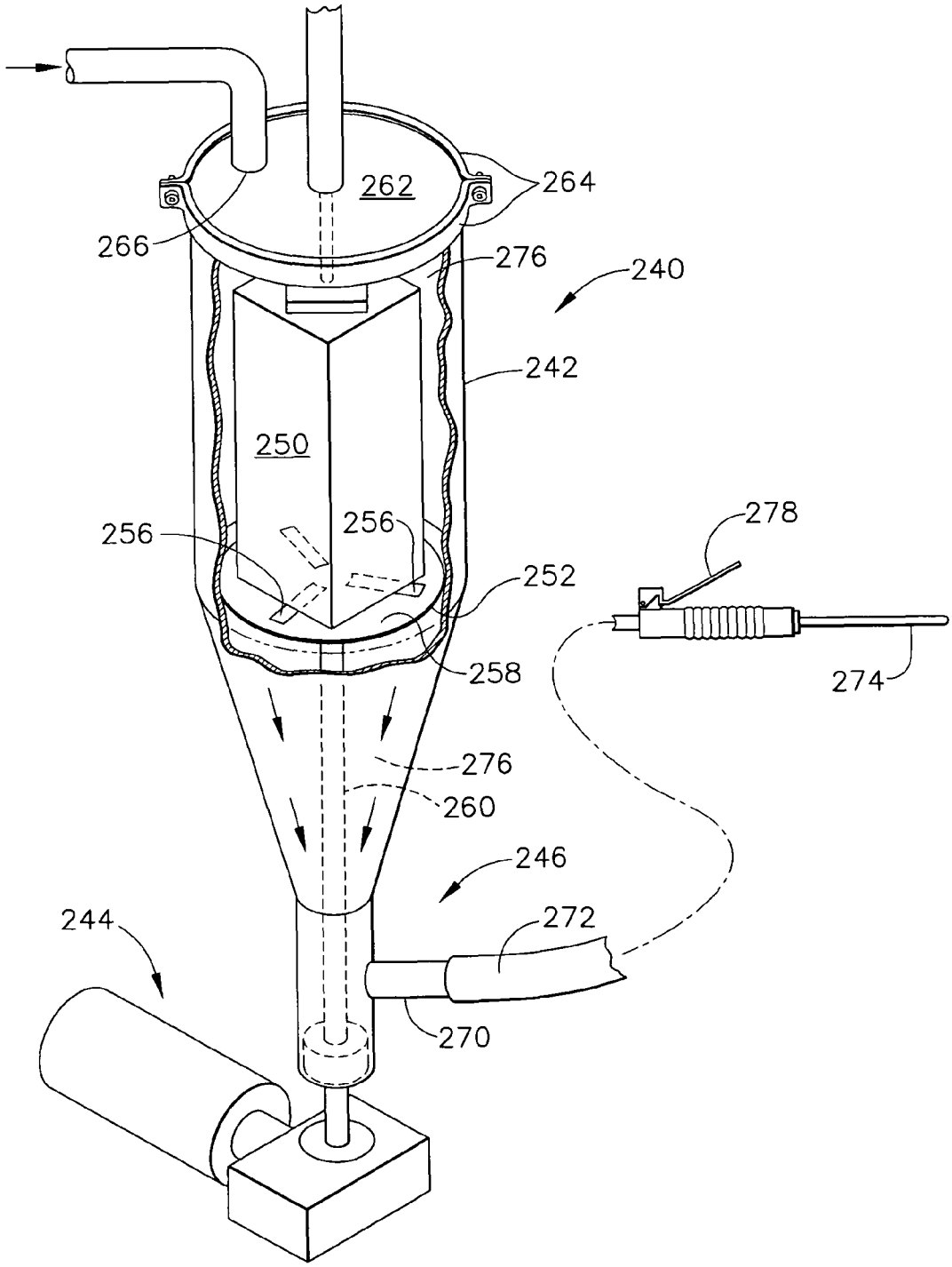
FIG. 15 is cut away perspective view of another embodiment of a particle blast apparatus.

FIG. 15 illustrates another embodiment. Particle blast apparatus 240 includes container 242, drive assembly 244 and exit port assembly 246. Container 240 includes upper portion 248 which is configured to receive and hold bulk blast media 250, such as a block of carbon dioxide. Shaving assembly 252 engages the lower end of media 250, while member 252 resists rotation of media 250 and, along with the weight of media 250, urges media 250 toward shaving assembly 252. In the embodiment depicted, shaving assembly 252 includes inclined blades 256 mounted to rotatable disk 258. Disk 258 is driven by shaft 260 which is driven by drive assembly 244. Shaving may produce very small, snow type particles when media 250 is carbon dioxide.

In the embodiment depicted, container 242 is also configured to hold internal pressure, by preventing substantial pressure leakage out of container 242. As with container 4 described above, depending on the internal pressure, container 242 may be constructed to meet the ASME code for pressure vessels. Cover 262 encloses the open end of container 242, forming a pressure resistant seal therewith, by any suitable configuration such as by an overcenter clamping arrangement as described above, or by two piece band 264 as shown.

Transport gas is introduced into container 242 at any suitable location. As shown in the embodiment depicted, transport gas inlet 266 is formed in cover 262 and connectable to a source of transport gas. The gas flows past shaving assembly 252 whereafter particles shaved from media 250 are entrained in the transport gas flow, flowing through conically shaped lower portion 268, through exit tube 270, through delivery hose 272 and ultimately out blast nozzle 274. It will be appreciated that container 242 is not limited to the configuration illustrated and described herein, but may have any suitable shape.

In the embodiment of FIG. 15, interior 276 of container 242 remains in fluid communication with the ambient through delivery hose 272 and nozzle 274. As in the previous embodiments, an air lock is not present. At start up, interior 276 become pressurized, with the attendant delay in maximum flow out of nozzle 274 until interior 276 is fully pressurized. Upon release of trigger 278, rotation of disk 258 stops thereby ceasing production of blast media particles, and transport gas will flow out of interior carrying any entrained particles as well as clearing hose 272 of any particles.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims submitted herewith.

What is claimed is:

1. A particle blast cleaning apparatus, comprising:
   a. a container having a container exit, said container defining an internal cavity, said internal cavity being configured to prevent substantial pressure leakage out of said internal cavity and to have particles disposed therein;
   b. an internal passageway in fluid communication with said container exit, said internal passageway comprising:
      i. a feeder assembly having a feeder inlet at which particles are received from said internal cavity, a discharge station downstream of said feeder inlet at which particles are discharged, and a rotor interposed between said feeder inlet and said discharge station, said feeder inlet being in fluid communication with said container exit, said feeder not comprising an airlock; and
      ii. an exit configured to be placed in fluid communication with a delivery hose; and
   c. an inlet port connectable to a source of pressurized transport gas, said inlet port configured to deliver pressurized transport gas into said internal passageway downstream of said feeder inlet.

2. The particle blast cleaning apparatus of claim 1, wherein said rotor is configured to grind or crush particles.

3. The particle blast cleaning apparatus of claim 2, wherein said rotor comprises a plurality of spaced apart discs carried by a rotatable shaft.

4. The particle blast cleaning apparatus of claim 3, wherein each of said plurality of spaced apart discs includes a respective outer periphery, the respective periphery of each of a plurality of said plurality of spaced apart discs configured as a series of teeth.

5. The particle blast cleaning apparatus of claim 1, wherein said rotor comprises a circumferential surface and a plurality of pockets disposed in said circumferential surface.

6. The particle blast cleaning apparatus of claim 1, wherein said inlet port is configured to deliver transport gas adjacent said rotor.

7. The particle blast cleaning apparatus of claim 1, wherein said inlet port is configured to deliver transport gas downstream of said rotor.

8. The particle blast cleaning apparatus of claim 1, wherein said container comprises sealable opening configured to receive particles.

9. A method of entraining particles in a flow of pressurized transport gas, said method comprising the steps of:
   a. providing an internal cavity configured to hold internal pressure and to have particles disposed therein, said internal cavity having an internal cavity exit;
   b. providing an internal passageway in fluid communication with said internal cavity exit, said internal passageway including an exit configured to be placed in fluid communication with a delivery hose;
   c. initiating and continuing flow of transport gas into said internal passageway, including the steps of:
      i. flowing said transport gas from said internal passageway upon initiation of said flow of transport gas into said internal cavity for an initial period of time until such time as pressure within said internal cavity inhibits further substantial flow of transport gas into said internal cavity; and
      ii. flowing said transport gas from said internal passageway out said exit.

10. The method of claim 9, wherein said internal passageway comprises a feeder assembly having a feeder inlet at which particles are received from said internal cavity and a discharge station downstream of said feeder inlet at which particles are discharged, said feeder inlet being in fluid communication with said internal cavity exit.

11. The method of claim 10, wherein the step of flowing said transport gas from said internal passageway upon initiation of said flow of transport gas into said internal cavity comprises the step of flowing transport gas first through said feeder prior to said transport gas flowing into said internal cavity.

12. The method of claim 11, comprising the step of disposing particles to be entrained in said flow of pressurized transport gas in said internal cavity, and wherein the step of flowing transport gas through said feeder comprises the step of pushing said particles away from said feeder assembly.

13. The method of claim 12, wherein upon expiration of said initial period of time, the step of pushing said particles away from said feeder assembly substantially ceases occurring.

14. The method of claim 12, wherein said feeder assembly comprises a rotor, and further comprising the step of rotating said rotor starting substantially concurrently with the step of pushing said particles away from said feeder assembly.

15. The method of claim 14, wherein the step of rotating said rotor is started after starting the step of pushing said particles away from said feeder assembly.

* * * * *